US006145595A

United States Patent [19]

Burris, II

[11] Patent Number: 6,145,595

[45] Date of Patent: Nov. 14, 2000

[54] ANNULUS PRESSURE REFERENCED CIRCULATING VALVE

[75] Inventor: Wesley J. Burris, II, Flower Mound, Tex.

[73] Assignee: Halliburton Energy Services, Inc., Dallas, Tex.

[21] Appl. No.: 09/167,045

[22] Filed: Oct. 5, 1998

[51] Int. Cl.[7] ..... E21B 34/10

[52] U.S. Cl. ..... 166/374; 137/68.23; 166/323; 166/386

[58] Field of Search ..... 91/443; 137/68.23, 137/68.25; 166/317, 321, 323, 374, 386

[56] References Cited

U.S. PATENT DOCUMENTS

| | | | |
|---|---|---|---|
| 4,324,293 | 4/1982 | Hushbeck | 166/317 |
| 4,420,044 | 12/1983 | Pullin et al. | 166/323 X |
| 4,691,779 | 9/1987 | McMahan et al. | 166/321 |
| 4,896,722 | 1/1990 | Upchurch | 155/374 X |
| 5,050,681 | 9/1991 | Skinner | 166/374 |
| 5,180,015 | 1/1993 | Ringgenberg et al. | 166/386 |
| 5,209,303 | 5/1993 | Barrington | 166/374 |
| 5,482,119 | 1/1996 | Manke et al. | 166/374 |
| 5,984,014 | 11/1999 | Poullard et al. | 166/374 |

OTHER PUBLICATIONS

Systems Engineering Bulletin, dated Oct. 9, 1990.
LPR–N Description, undated.
Select Tester Valve brochure, dated Jul. 21, 1998.

*Primary Examiner*—George Suchfield
*Attorney, Agent, or Firm*—Paul I. Herman; Marlin R. Smith

[57] ABSTRACT

A circulating valve and associated methods of using same provide control of fluid flow within a subterranean well. In a described embodiment, a circulating valve includes a fluid pressure storage chamber in fluid communication with the exterior of the valve. When positioned in a wellbore, fluid pressure in an annulus between the valve and the wellbore is stored in the storage chamber. A subsequent, relatively rapid, increase in the annulus fluid pressure causes the valve to operate.

18 Claims, 6 Drawing Sheets

ANNULUS PRESSURE REFERENCED CIRCULATING VALVE

BACKGROUND OF THE INVENTION

The present invention relates generally to operations performed in conjunction with subterranean wells and, in an embodiment described herein, more particularly provides an annulus pressure referenced circulating valve.

It is well known in the art to operate a valve positioned in a subterranean well by applying fluid pressure to the valve. The fluid pressure may exist by virtue of the weight of fluid in the well, the fluid pressure may be applied to the valve by, for example, a pump at the earth's surface or in the well, and the fluid pressure may be a combination of these. When the valve is interconnected in a tubular string positioned in a wellbore of the well, the fluid pressure may exist in the tubular string, in an annulus formed between the tubular string and the wellbore, or the valve may be operated by a difference between fluid pressure in the tubular string and fluid pressure in the annulus.

Where a valve is operated by absolute fluid pressure in a tubular string or in an annulus exterior to the valve, the valve typically includes a chamber at atmospheric pressure or an elevated precharged pressure at the earth's surface. After positioning in the well, a fluid pressure differential (equal to the difference between the chamber pressure and the pressure in the tubular string or annulus) is generally created across a member releasably secured against displacement by, for example, one or more shear pins. When a predetermined fluid pressure differential is reached, the member is released and displaced by the differential pressure, thereby operating the valve. Unfortunately, however, it is often uncertain what pressure conditions will be experienced in the well prior to installing the valve in the tubular string, so there is a danger that the valve will be inadvertently operated due to an unexpected pressure increase in the tubular string or annulus.

Where the valve is operated in response to a pressure differential between the tubular string and the annulus, the member is typically released for displacement when the predetermined fluid pressure differential is created. While, strictly speaking, operation of this type of valve does not require prior knowledge of absolute fluid pressures in either the tubular string or annulus, it does requires prior knowledge of fluid pressures to be experienced in both the tubular string and the annulus, so that the fluid pressure differential may be determined and the valve may be set up to avoid inadvertent operation of the valve.

Solutions to the problem of inadvertent operation of pressure responsive valves have been implemented. For example, it is common for a valve to include a chamber at an elevated pressure and a member displaceable in response to a difference in pressure between the chamber and the tubular string, the annulus, or a difference between the tubular string and annulus pressures. By manipulating the tubular string pressure, the annulus pressure, or the difference between the tubular string and annulus pressures, the member is made to displace repeatedly, the member displacing sufficiently to operate the valve after a predetermined number of the pressure manipulations. The number of pressure manipulations is usually determined by a ratchet or J-slot mechanism. Unfortunately, this type of valve requires numerous pressure manipulations, and a complex and expensive ratchet or J-slot mechanism.

Therefore, it would be highly desirable to provide a valve responsive to fluid pressure in a well, which does not require numerous pressure manipulations or precise prior knowledge of fluid pressures to be experienced in the well, and which is relatively uncomplicated in its construction and use.

SUMMARY OF THE INVENTION

In carrying out the principles of the present invention, in accordance with an embodiment thereof, a circulating valve is provided which is annulus pressure referenced. The valve stores annulus pressure in an internal chamber as a variable reference. A subsequent relatively rapid increase in annulus pressure relative to that previously stored in the chamber causes the valve to operate. The valve is nonresponsive to fluid pressure in an axial flow passage formed therethrough.

In one aspect of the present invention, the valve includes a specially configured hydraulic circuit. The hydraulic circuit includes two portions interconnected in series between a fluid pressure source external to the valve, and a fluid pressure storage chamber within the valve. As fluid pressure external to the valve gradually increases and decreases, the hydraulic circuit permits the fluid pressure to be stored in the chamber. The hydraulic circuit portions permit substantially restricted fluid flow from the valve exterior to the chamber, and permit substantially unrestricted fluid flow from the chamber to the valve exterior.

However, when the external fluid pressure is relatively rapidly increased, one of the hydraulic circuit portions opens to permit substantially unrestricted flow therethrough from the valve exterior, while the other hydraulic circuit portion continues to substantially restrict fluid flow therethrough, thereby causing displacement of the hydraulic circuit portions relative to each other. Since one of the hydraulic circuit portions is incorporated in a housing assembly of the valve, and the other hydraulic circuit portion is incorporated in a structure displaceable relative to the housing assembly, displacement of the hydraulic circuit portions relative to each other causes displacement of the structure relative to the housing assembly.

In another aspect of the present invention, a structure selectively blocks and permits fluid flow through a sidewall of a housing assembly. The structure is sealingly engaged and displaceable within the housing assembly. A first hydraulic circuit portion regulates fluid flow between a fluid pressure source and a second hydraulic circuit portion across a portion of the housing assembly sealingly engaged with the structure. The second hydraulic circuit portion regulates fluid flow between the first circuit portion and a fluid pressure storage chamber across a portion of the structure sealingly engaged with the housing assembly. The second circuit portion is displaceable with the structure relative to the housing assembly.

These and other features, advantages, benefits and objects of the present invention will become apparent to one of ordinary skill in the art upon careful consideration of the detailed description of a representative embodiment of the invention hereinbelow and the accompanying drawings. hydraulic circuit 16 from the chamber 18. An annular piston 26 sealingly and reciprocably disposed in the chamber 24 between the sleeve 14 and the housing assembly 12 isolates the fluid flowed through the hydraulic circuit 16 from a volume of compressible fluid, such as Nitrogen, in the chamber 24 below the piston.

The valve 10 is representatively illustrated in FIGS. 1A&1B in a configuration in which the valve is run into a well as a part of a tubular string. The piston 26 is illustrated in FIG. 1B as being downwardly spaced apart from a radially enlarged portion 28 of the sleeve 14. This downward displacement of the piston 26 is due to fluid pressure greater than that of the compressible fluid in the chamber 24 entering the port 20, forcing fluid from the chamber 18 through the hydraulic circuit 16 and into the chamber 24 above the piston 26, and compressing the compressible fluid in the chamber 24, for example, due to increased hydrostatic pressure in the annulus surrounding the valve.

Such transfer of fluid from the upper chamber 18 to the lower chamber 24 through the hydraulic circuit 16, due to increasing hydrostatic pressure as the valve 10 is lowered in a well, is at a relatively low flow rate. This is because hydrostatic pressure increases very gradually as the valve 10 is lowered in the well. The hydraulic circuit 16 permits such low flow rate transfers of fluid from the upper chamber 18 to the lower chamber 24, without causing any change in the configuration of the valve 10.

DETAILED DESCRIPTION

Figure 1A:
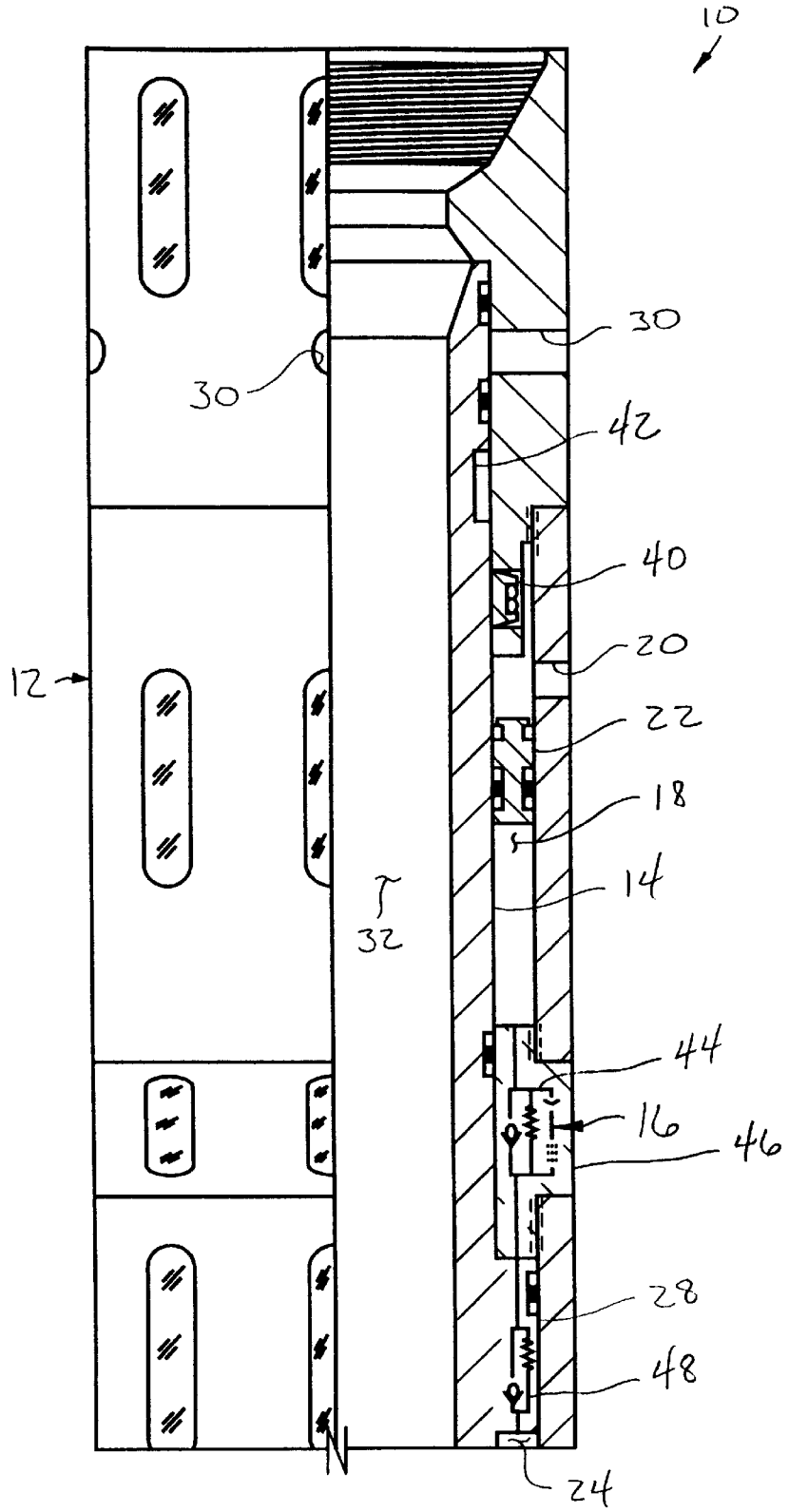
FIGS. 1A&1B are quarter-sectional views of successive axial portions of an annulus pressure referenced circulating valve embodying principles of the present invention, the circulating valve being shown in a closed configuration thereof.
Figure 1B:
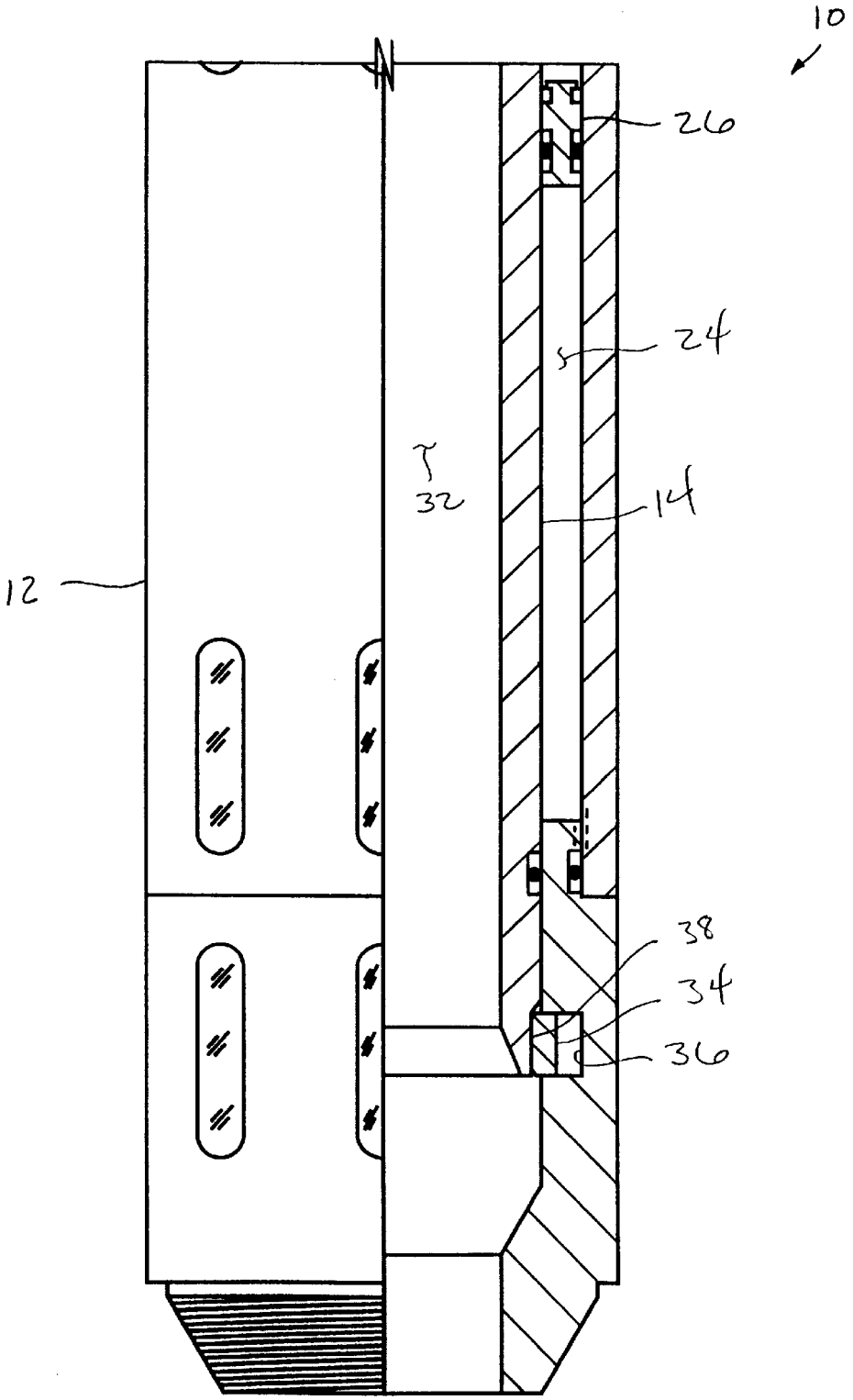

Representatively illustrated in FIGS. 1A&1B is an annulus pressure referenced circulating valve 10 which embodies principles of the present invention. In the following description of the circulating valve 10 and other apparatus and methods described herein, directional terms, such as "above", "below", "upper" "lower", etc., are used for convenience in referring to the accompanying drawings. Additionally, it is to be understood that the various embodiments of the present invention described herein may be utilized in various orientations, such as inclined, inverted, horizontal, vertical, etc., without departing from the principles of the present invention.

The circulating valve 10 includes an outer housing assembly 12, a generally tubular structure or sleeve 14, and a hydraulic circuit 16. The hydraulic circuit 16 is representatively illustrated in FIG. 2 apart from the remainder of the circulating valve 10, and is described in more detail hereinbelow.

An annular chamber 18 is formed between the sleeve 14 and the housing assembly 12. The annular chamber 18 is in fluid communication with the exterior of the valve 10 via a port 20 formed through a sidewall of the housing assembly. When the circulating valve 10 is interconnected in a tubular string and positioned within a wellbore (see FIG. 4), the port 20 permits fluid flow between the chamber 18 and an annulus formed between the tubular string and the wellbore. An annular piston 22 sealingly and reciprocably disposed between the housing assembly 12 and the sleeve 14 isolates wellbore fluids from the hydraulic circuit 16, while still permitting transfer of fluid pressure from the annulus to the hydraulic circuit. For this purpose, a clean fluid, such as oil, silicone fluid, etc., is contained in the chamber 18 between the piston 22 and the hydraulic circuit 16.

Another annular chamber 24 is formed between the sleeve 14 and the housing assembly 12. The chamber 24 receives fluid flowed through the In the configuration of the valve 10 depicted in FIGS. 1A&1B, the sleeve 14 prevents fluid flow through openings 30 formed through a sidewall of the housing assembly 12. If the sleeve 14 is downwardly displaced relative to the housing assembly 12, the openings 30 will no longer be blocked by the sleeve, and fluid flow will be permitted through the openings. In this manner, fluid communication is established between the exterior of the valve 10 and an inner axial flow passage 32 formed through the valve. It will be readily appreciated by one skilled in the art that such downward displacement of the sleeve 14 relative to the housing assembly 12 will also permit fluid communication between the annulus and an axial flow passage of a tubular string, when the valve 10 is interconnected in the tubular string and positioned in a well, thereby permitting fluid circulation through the tubular string and annulus in the well.

The sleeve 14 is releasably retained in its position blocking fluid flow through the openings 30 by a generally C-shaped snap ring 34. The snap ring 34 is received in an annular groove 36 formed internally in the housing assembly 12. The snap ring 34 is also engaged with a radially reduced portion 38 formed on the sleeve 14. It will be readily appreciated that a sufficiently large downwardly biasing force must be applied to the sleeve 14 to radially enlarge the snap ring 34 and permit the sleeve to displace downwardly. Of course, other means of releasably retaining the sleeve 14, such as shear pins, a shear ring, a releasable latch, etc., could be utilized in place of the snap ring 34, without departing from the principles of the present invention.

Another snap ring 40 is positioned in the housing assembly 12 for engagement with an annular groove 42 formed externally on the sleeve 14. The snap ring 40 could be similar to the snap ring 34, but is depicted in FIG. 1A as being of the conventional type which is circumferentially segmented and biased radially inward by springs encircling the segments. When the sleeve 14 is downwardly displaced relative to the housing assembly 12 to open the valve 10 and permit fluid flow through the openings 30, the snap ring 40 radially inwardly retracts into the groove 42 and thereby prevents further displacement of the sleeve relative to the housing assembly. Thus, the valve 10 as representatively illustrated in FIGS. 1A&1B is a "one-shot" valve that is actuated only once to open the valve, and the valve is not subsequently closed. However, it is to be clearly understood that principles of the present invention may be incorporated in apparatus other than a "one-shot" circulating valve.

Note that a portion 44 of the hydraulic circuit 16 is disposed within a threaded coupling 46 of the housing assembly 12, and that another portion 48 of the hydraulic circuit is disposed within the radially enlarged portion 28 of the sleeve 14. Thus, when the sleeve 14 displaces relative to the housing assembly 12, the hydraulic circuit portion 48 also displaces relative to the other hydraulic circuit portion 44. In addition, note that, since the sleeve 14 is sealingly engaged with the housing assembly 12 within the coupling 46 and at the radially enlarged portion 28, the upper hydraulic circuit portion 44 regulates fluid flow between the upper chamber 18 and the lower hydraulic circuit portion 48, and the lower hydraulic circuit portion 48 regulates fluid flow between the upper hydraulic circuit portion 44 and the lower chamber 24.

Figure 2:
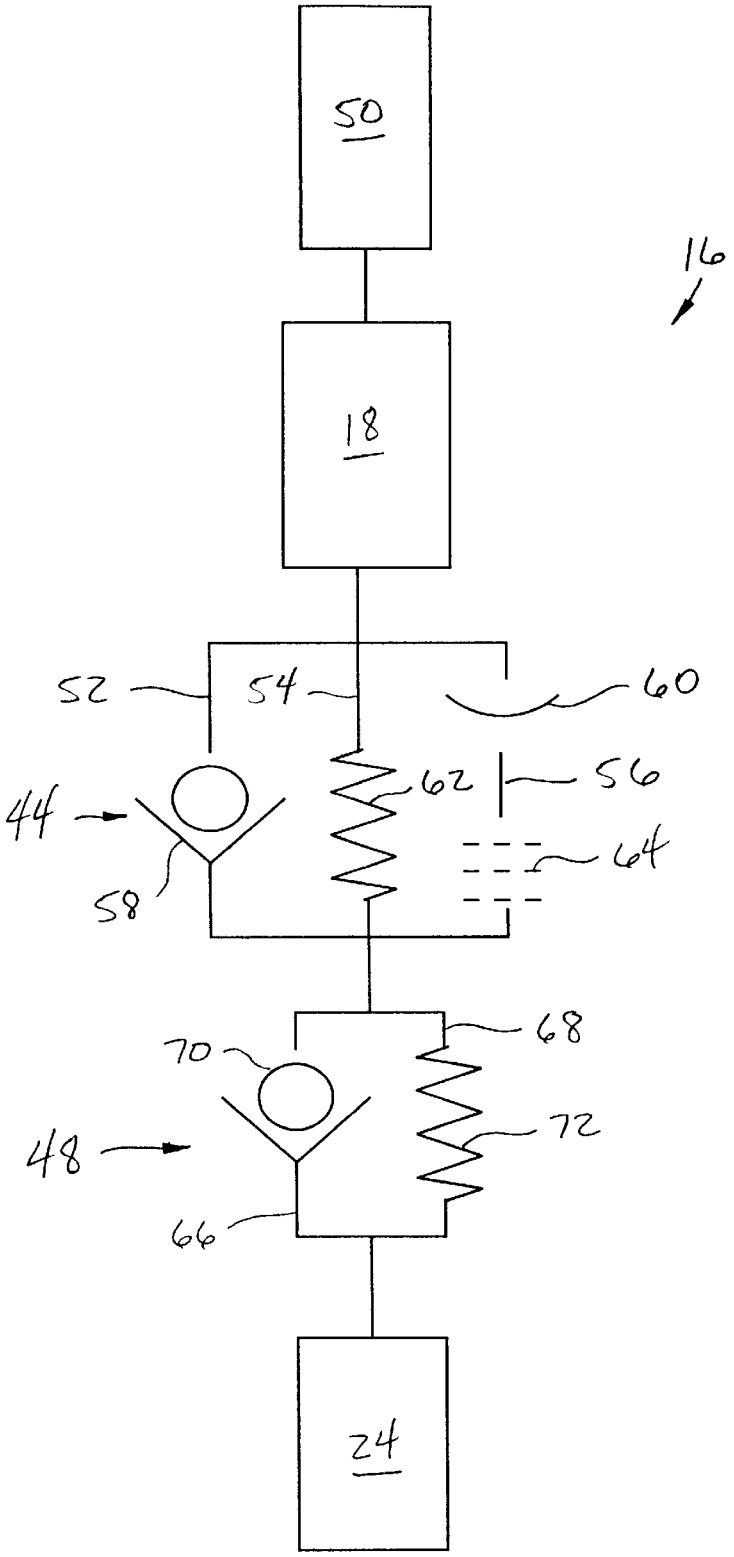
FIG. 2 is a schematic diagram of a hydraulic circuit of the circulating valve of FIGS. 1A&1B.

Referring additionally now to FIG. 2, the hydraulic circuit 16 is schematically and representatively illustrated apart from the remainder of the valve 10. The hydraulic circuit 16 includes the portions 44, 48, the upper chamber 18 and the lower chamber 24. A fluid pressure source 50 is shown in FIG. 2, but it may or may not be considered a part of the hydraulic circuit 16, depending upon the configuration of the valve 10. For example, in the embodiment of the valve 10 depicted in FIGS. 1A&1B, the fluid pressure source 50 is the exterior of the valve, which is an annulus between the valve and a wellbore when the valve is positioned in the wellbore. The fluid pressure source 50 may also include a pump, such as a mud pump at the earth's surface, which may be used to apply fluid pressure to the annulus, or a downhole pump connected to the valve 10 within the well. Thus, the fluid pressure source 50 shown in FIG. 2 may be any means of introducing fluid pressure to the valve 10.

As shown in FIG. 2, fluid pressure from the fluid pressure source 50 enters the chamber 18. In the valve 10, the fluid pressure enters the chamber 18 via the port 20. Note that the chamber 18 is not necessary in an apparatus constructed in accordance with the principles of the present invention, since fluid pressure could be transmitted directly from the fluid pressure source 50 to the upper hydraulic circuit portion 44.

Fluid flows from the chamber 18 through the upper hydraulic circuit portion 44 to the lower hydraulic circuit portion 48, the circuit portions being interconnected in series between the chambers 18 and 24. The upper hydraulic circuit portion 44 includes three parallel flowpaths 52, 54, 56. Fluid flows from the upper chamber 18 to the lower hydraulic circuit portion 48 through the flowpath 54, which includes a flow restrictor 62, such as a choke or an orifice.

A check valve 58 prevents fluid flow from the chamber 18 to the lower hydraulic circuit portion 48 through the flowpath 52. A rupture disk 60 or other releasable fluid pressure barrier prevents fluid flow from the chamber 18 to the lower hydraulic circuit portion 48 through the flowpath 56 until a predetermined fluid pressure differential is created across the upper hydraulic circuit portion 44, at which time the rupture disk 60 ruptures, permitting substantially unrestricted fluid flow through the flowpath 56. A screen 64 or other filtering device prevents fragments of the rupture disk 60 from entering the lower hydraulic circuit portion 48 after the rupture disk 60 ruptures.

The restrictor 62 and rupture disk 60 are selected so that fluid may flow through the upper hydraulic circuit portion 44 from the upper chamber 18 to the lower hydraulic circuit portion 48 at a relatively low flow rate, without creating a sufficient fluid pressure differential across the upper hydraulic circuit portion 44 to cause the rupture disk 60 to rupture. This permits fluid pressure to be transmitted from the fluid pressure source 50 to the lower chamber 24, where the fluid pressure is stored as a reference pressure. For example, when the valve 10 is conveyed into a well as a part of a tubular string, gradually increasing hydrostatic fluid pressure in an annulus between the wellbore and the valve is stored in the lower chamber 24, without causing rupture of the rupture disk 60. Additionally, fluid pressure in the annulus (or other fluid pressure source) may increase above hydrostatic pressure, without causing rupture of the rupture disk 60, as long as the restrictor 62 can meter fluid flow through the flowpath 54 and prevent a sufficiently great differential pressure from being created across the upper circuit portion 44. Or, stated differently, fluid pressure increases are transmitted from the upper chamber 18 to the lower circuit portion 48 exclusively through the flowpath 54, until the rate of fluid pressure increase is sufficiently great to cause the predetermined pressure differential to be created across the upper circuit portion 44, at which time the rupture disk 60 ruptures, permitting a relatively high rate of fluid flow through the flowpath 56.

The lower circuit portion 48 includes two parallel flowpaths 66, 68. A check valve 70 prevents fluid flow from the upper circuit portion 44 to the chamber 24 through the flowpath 66. A flow restrictor 72 restricts fluid flow through the flowpath 68.

Recall that the lower circuit portion 48 is disposed in the sleeve 14. The restrictor 72 is sized so that when the rupture disk 60 ruptures, a fluid pressure differential is created across the lower circuit portion 48 sufficiently great to bias the sleeve 14 downwardly, radially expanding the snap ring 34 and downwardly displacing the sleeve relative to the housing assembly 12. Thus, the restrictor 72 preferably permits fluid flow therethrough at a relatively low flow rate for storing fluid pressure in the chamber 24, but when the rupture disk 60 ruptures, the resulting pressure differential across the lower circuit portion 48 requires a relatively high rate of fluid flow through the restrictor 72. This differential pressure biases the sleeve 14 downward relative to the housing assembly 12.

The check valves 58, 70 permit substantially unrestricted flow of fluid from the chamber 24 to the chamber 18 through the circuit portions 44, 48. Thus, when fluid pressure of the fluid pressure source 50 decreases, the reference fluid pressure stored in the chamber 24 is also permitted to readily decrease therewith. However, it will be readily appreciated that the check valves 58, 70 are not necessary in the valve 10 if a pressure relief valve is used instead of a rupture disk since fluid may also flow through the restrictors 62, 72 from the chamber 24 to the chamber 18.

It will now be fully appreciated that fluid pressure stored in the chamber 24 corresponds to fluid pressure external to the housing assembly 12. When the valve 10 is interconnected in a tubular string positioned in a wellbore of a well,. this stored fluid pressure corresponds to fluid pressure in an annulus between the valve and the wellbore. When fluid pressure in the annulus is gradually increased, due to an increase in hydrostatic pressure and/or due to fluid pressure otherwise applied to the annulus, the increased fluid pressure is transmitted through the hydraulic circuit 16 for storage in the chamber 24. When fluid pressure in the annulus is decreased, fluid in the chamber 24 is transmitted through the hydraulic circuit 16 to the chamber 18, thereby permitting a corresponding decrease in the stored fluid pressure. In this manner, the circulating valve 10 is annulus pressure referenced.

However, when fluid pressure in the annulus is relatively rapidly increased, for example, due to fluid pressure being applied to the annulus by a pump, this increased fluid pressure relative to the fluid pressure stored in the chamber 24 causes a pressure differential to be created across the upper circuit portion 44, rupturing the rupture disk 60. When the rupture disk 60 ruptures, a pressure differential is created across the lower circuit portion 48, which biases the sleeve 14 downwardly to open the valve 10. Thus, by manipulating the fluid pressure in the annulus in a manner changing such fluid pressure at a rate greater than a predetermined pressure change rate at which the valve 10 operates (i.e., a pressure change rate in the hydraulic circuit portion 44 greater than that which the above-described rupture disk 60 can stand without rupturing), the valve 10 is operated by downwardly shifting its sleeve 14 as described above.

Figure 3A:
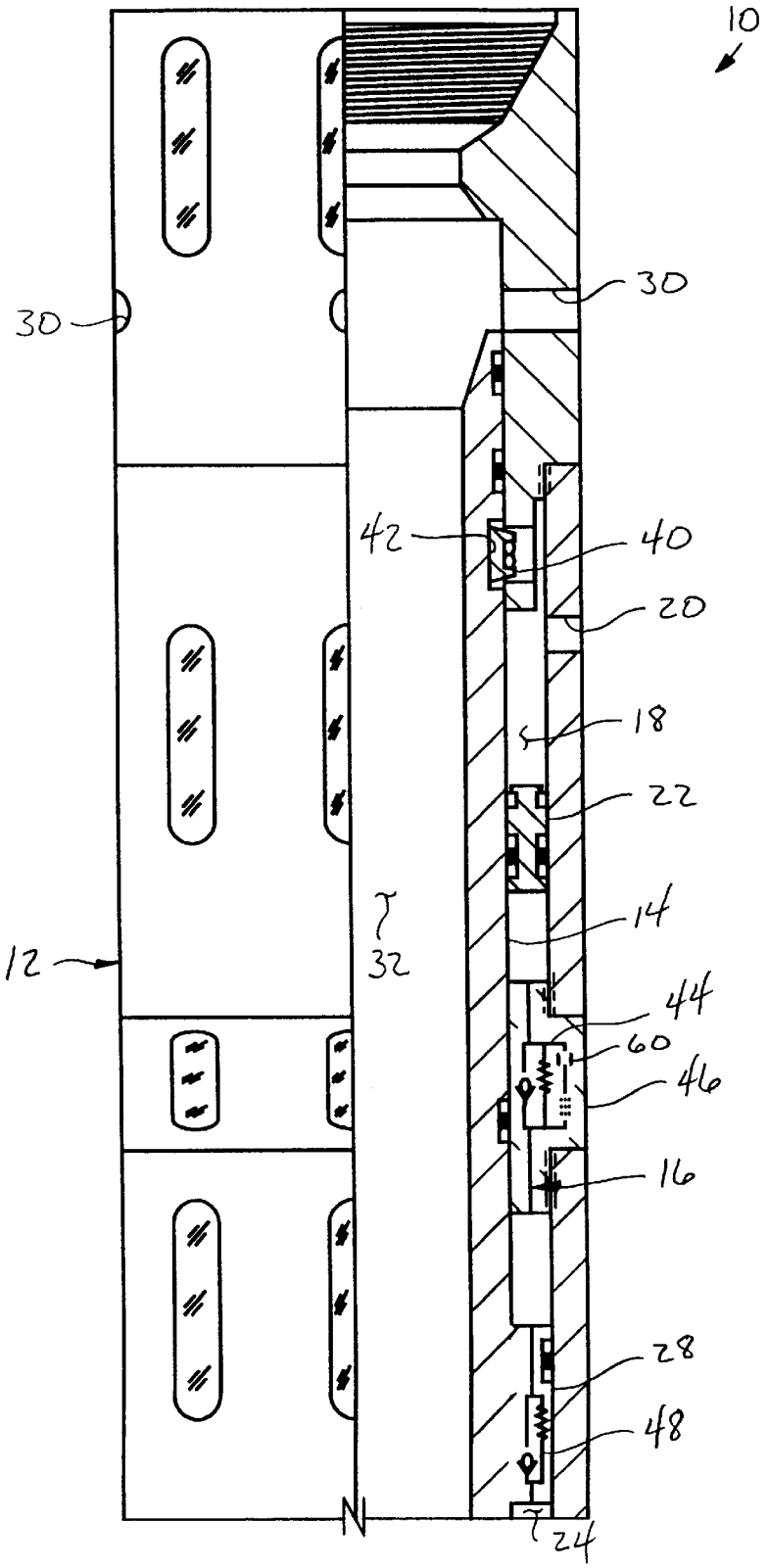
FIGS. 3A&3B are quarter-sectional views of successive axial portions of the circulating valve of FIGS. 1A&1B, the circulating valve being shown in an open configuration thereof.
Figure 3B:
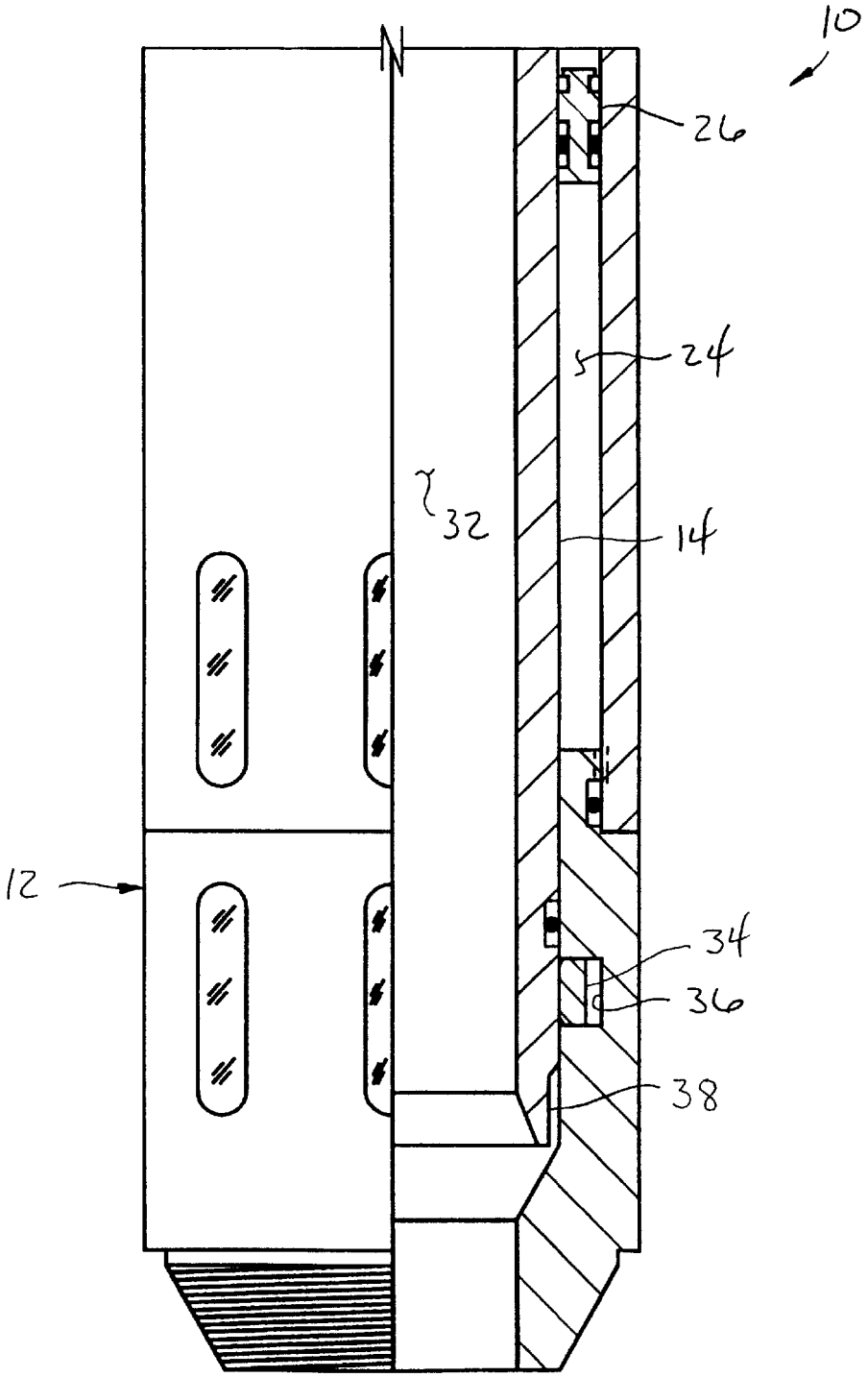

Referring additionally now to FIGS. 3A&3B, the valve 10 is representatively illustrated in a configuration in which it has been opened as described above. The rupture disk 60 has been ruptured and a differential pressure has been created across the lower circuit portion 48 sufficiently great to radially enlarge the snap ring 34 and downwardly displace the sleeve 14 relative to the housing assembly 12. The openings 30 are now open to fluid flow therethrough between the flow passage 32 and the exterior of the housing assembly 12. The snap ring 40 has radially inwardly retracted into the groove 42, thereby substantially preventing further displacement of the sleeve 14 relative to the housing assembly 12.

Note that the piston 26 has displaced further downward in the chamber 24. Prior to running the valve 10, the chamber 24 below the piston 26 should be charged with a compressible fluid, such as Nitrogen, at a pressure somewhat less than the expected hydrostatic pressure in the well at the depth the valve 10 is to be installed, compensated for temperature. It is preferred that the volume of the chamber 24 below the piston 26 be decreased by approximately 10% when the valve 10 is properly positioned in the well. The volume of the chamber 24 below the piston 26 should permit the sleeve 14 to displace downwardly to its position shown in FIGS. 3A&3B, for example, so that a pressure differential still exists across the radially enlarged portion 28 of the sleeve (and, thus, across the lower circuit portion 48) when the snap ring 40 retracts into the groove 42. It is preferred that the remaining pressure differential across the lower circuit portion 48 produces a downwardly biasing force at least about 25% greater than that needed to displace the sleeve 14 at the time the snap ring 40 retracts into the groove 42.

Figure 4:
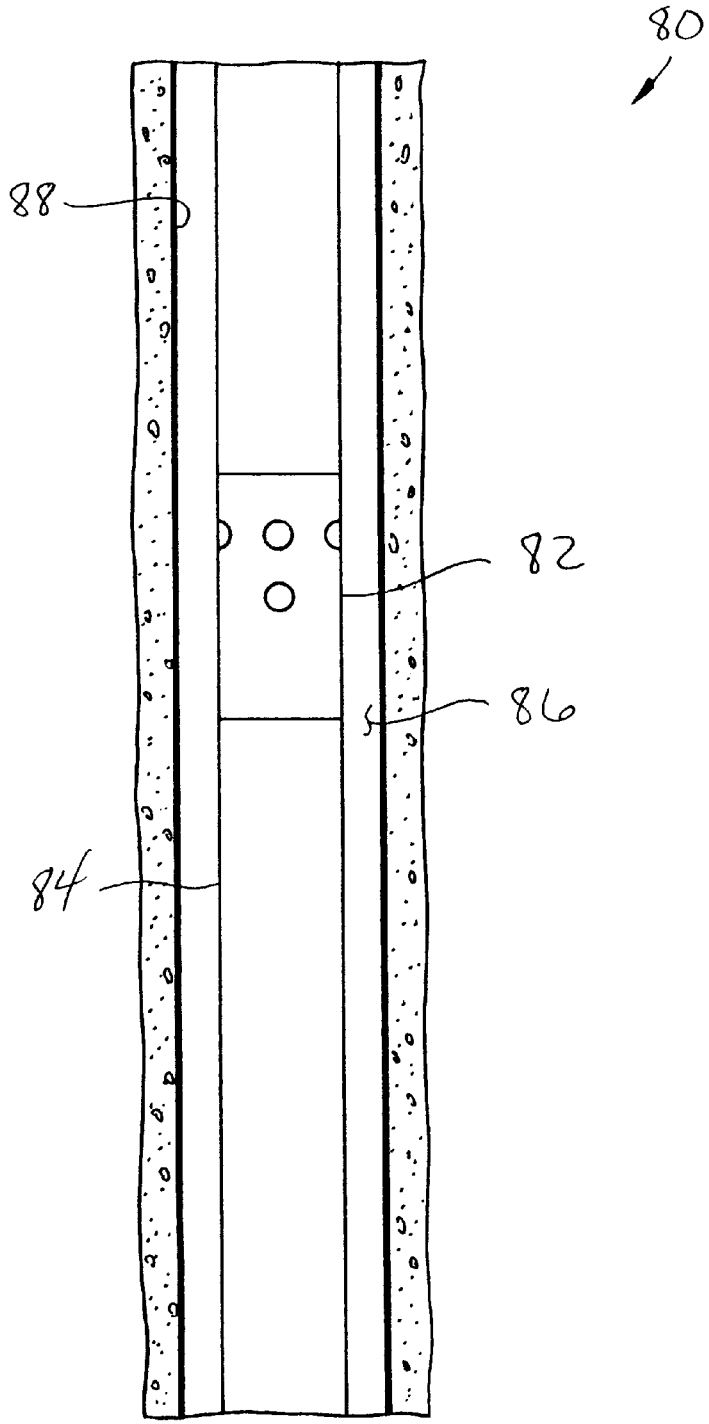
FIG. 4 is a schematic illustration of a method of using the circulating valve of FIGS. 1A&1B, the method embodying principles of the present invention.

Referring additionally now to FIG. 4, a method 80 of controlling fluid flow within a subterranean well is representatively illustrated. In the method 80, a circulating valve 82 is interconnected in a tubular string 84. The valve 82 may be the valve 10 described above, or it may be another differently constructed annulus pressure referenced circulating valve. The tubular string 84 may be a string of production tubing, a drill stem test string, etc.

An internal axial flow passage of the tubular string 84 extends axially through the valve 82. If the valve 82 is similar to the valve 10 described above, the flow passage 32 is in fluid communication with the remainder of the flow passage in the tubular string 84. The valve 82 initially prevents fluid communication between the flow passage of the tubular string 84 and an annulus 86 formed between a wellbore 88 of the well.

As the tubular string 84 is lowered into the well, hydrostatic pressure in the annulus 86 increases. The valve 82 stores this fluid pressure internally as a reference. When the valve 82 is appropriately positioned in the wellbore 88, additional fluid pressure is applied to the annulus 86, for example, by a pump connected to the annulus via a wellhead at the earth's surface. This additional fluid pressure is applied to the annulus 86 relatively rapidly, as compared to the increase in hydrostatic pressure due to lowering of the tubular string 84 in the wellbore 88.

The relatively rapid increase in fluid pressure in the annulus 86 causes the valve 82 to open, thereby permitting fluid communication between the annulus 86 and the internal axial flow passage of the tubular string 84. Fluid may now be circulated from the annulus 86, in through the valve 82 and into the tubular string 84. Of course, this fluid flow could be reversed, as well.

It may now be fully appreciated that the valve 10 and the method 80 permit valve actuation without requiring prior knowledge of the precise fluid pressures in the annulus 86 or tubular string 84, or both of them. Additionally, it is not necessary for multiple fluid pressure applications to be accomplished to actuate the valve 10 or 82. Instead, the valve 10 or 82 carries an internal fluid pressure reference, which may increase or decrease depending upon the actual fluid pressure in the annulus 86. The valve 10 or 82 is actuated only by a relatively rapid increase in fluid pressure in the annulus 86, and is insensitive to fluid pressure in the tubular string.

Of course, many modifications, additions, deletions, substitutions, and other changes may be made to the valve 10 and method 80 described above, which changes would be obvious to one skilled in the art, and these changes are contemplated by the principles of the present invention. For example, the valve 10 could be easily configured to selectively permit and prevent fluid flow through the flow passage 32 by connecting the sleeve 14 to a conventional ball valve mechanism, so that displacement of the sleeve causes actuation of the ball valve mechanism. Accordingly, the foregoing detailed description is to be clearly understood as being given by way of illustration and example only, the spirit and scope of the present invention being limited solely by the appended claims.

What is claimed is:

1. A method of controlling fluid flow within a subterranean well, the method comprising the steps of:

interconnecting a circulating valve in a tubular string;

positioning the tubular string in a wellbore of the well, thereby forming an annulus between the wellbore and the tubular string;

admitting a first fluid pressure from the annulus into the circulating valve;

storing the first fluid pressure in a chamber within the circulating valve; and applying to the annulus a second fluid pressure greater than the first fluid pressure, thereby creating a predetermined fluid pressure differential between the chamber and the annulus.

2. The method according to claim 1, wherein the applying step further comprises opening the circulating valve in response to creation of the fluid pressure differential.

3. The method according to claim 2, wherein the opening step further comprises permitting fluid flow through a sidewall portion of the circulating valve.

4. The method according to claim 2, wherein the opening step further comprises permitting fluid flow between the annulus and an axial flow passage of the tubular string.

5. The method according to claim 2, wherein the applying step further comprises opening a releasable pressure barrier within the circulating valve.

6. The method according to claim 5, wherein the opening step comprises rupturing a rupture disk within the circulating valve.

7. A method of controlling fluid flow within a subterranean well, the method comprising the steps of:

interconnecting a circulating valve in a tubular string;

positioning the tubular string in a wellbore of the well, thereby forming an annulus between the wellbore and the tubular string;

storing the first fluid pressure in a chamber within the circulating valve; and applying a second fluid pressure to the annulus, thereby creating a predetermined fluid pressure differential between the chamber and the annulus and opening the circulating valve in response to creation of the fluid pressure differential, the applying step including opening a releasable pressure barrier within the circulating valve, the releasable pressure being included in a first flowpath within the circulating valve in parallel with a second flow path including a flow restrictor, the flow restrictor restricting fluid flow between the annulus and the chamber.

8. A method of controlling fluid flow within a subterranean well, the method comprising the steps of:

providing a valve including a hydraulic circuit having first and second portions, the first circuit portion regulating fluid flow between the exterior of the valve and the second circuit portion, and the second circuit portion regulating fluid flow between the first circuit portion and a fluid pressure storage chamber;

interconnecting the valve in a tubular string;

positioning the tubular string in a wellbore of the well, thereby forming an annulus between the tubular string and the wellbore; and manipulating fluid pressure in the annulus, to operate the valve, by changing the fluid pressure at a rate greater than a predetermined pressure change rate at which the valve operates.

9. The method according to claim 8, wherein the manipulating step further comprises storing a first annulus fluid pressure in the fluid pressure storage chamber, and then applying a second fluid pressure to the annulus, thereby creating a predetermined fluid pressure differential.

10. The method according to claim 9, wherein in the applying step, the fluid pressure differential is created across the second circuit portion.

11. The method according to claim 9, wherein in the applying step, the valve is operated in response to creation across the second circuit portion of the fluid pressure differential.

12. The method according to claim 9, wherein in the manipulating step, the first annulus fluid pressure is admitted to the fluid pressure storage chamber through the first and second circuit portions.

13. The method according to claim 12, wherein in the applying step, the second annulus fluid pressure is admitted substantially unrestricted through the first circuit portion.

14. The method according to claim 12, wherein in the applying step, admission of the second annulus fluid pressure through the second circuit portion to the fluid pressure storage chamber is substantially restricted, thereby creating the predetermined fluid pressure differential across the second circuit portion.

15. A method of controlling fluid flow within a subterranean well, the method comprising the steps of:

providing a valve including a hydraulic circuit having first and second portions, the first circuit portion regulating fluid flow between the exterior of the valve and the second circuit portion, and the second circuit portion regulating fluid flow between the first circuit portion and a fluid pressure storage chamber;

interconnecting the valve in a tubular string;

positioning the tubular string in a wellbore of the well, thereby forming an annulus between the tubular string and the wellbore; and manipulating fluid pressure in the annulus, thereby operating the valve, the manipulating step including storing a first annulus fluid pressure in the fluid pressure storage chamber, and then applying a second fluid pressure to the annulus, thereby creating a predetermined fluid pressure differential, the first annulus fluid pressure being admitted to the fluid pressure storage chamber through the first and second circuit portions, a fluid pressure barrier of the first circuit portion opening in response to application of the second annulus fluid pressure.

16. A method of controlling fluid flow within a subterranean well, the method comprising the steps of:

providing a valve including a hydraulic circuit having first and second portions, the first circuit portion regulating fluid flow between the exterior of the valve and the second circuit portion, and the second circuit portion regulating fluid flow between the first circuit portion and a fluid pressure storage chamber;

interconnecting the valve in a tubular string;

positioning the tubular string in a wellbore of the well, thereby forming an annulus between the tubular string and the wellbore; and manipulating fluid pressure in the annulus, thereby operating the valve, the manipulating step including storing a first annulus fluid pressure in the fluid pressure storage chamber and then applying a second fluid pressure to the annulus, thereby creating a predetermined fluid pressure differential, wherein during the positioning and manipulating steps, substantially unrestricted fluid flow is permitted from the fluid pressure storage chamber to the annulus.

17. The method according to claim 16, wherein during the positioning and manipulating steps, fluid flow from the annulus to the fluid pressure storage chamber is substantially restricted through the first and second circuit portions, fluid flow through the first circuit portion becoming substantially unrestricted in response to application of the second fluid pressure to the annulus.

18. The method according to claim 8, wherein the manipulating step further comprises displacing a structure of the valve relative to a housing assembly of the valve in response to manipulation of the fluid pressure in the annulus, the structure being nonresponsive to fluid pressure in an axial flow passage of the tubular string.

* * * * *